US007715750B2

(12) United States Patent
Kagawa

(10) Patent No.: US 7,715,750 B2
(45) Date of Patent: May 11, 2010

(54) IMAGE FORMING APPARATUS, LUBRICANT APPLYING APPARATUS, CONTROL METHOD OF IMAGE FORMING APPARATUS

(75) Inventor: Toshiaki Kagawa, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 509 days.

(21) Appl. No.: 11/783,226

(22) Filed: Apr. 6, 2007

(65) Prior Publication Data

US 2007/0253726 A1 Nov. 1, 2007

(30) Foreign Application Priority Data

Apr. 28, 2006 (JP) ..... 2006-127058

(51) Int. Cl.
*G03G 15/02* (2006.01)
*G03G 21/00* (2006.01)

(52) U.S. Cl. ..... 399/100; 399/346

(58) Field of Classification Search ..... 399/101, 399/100, 346

See application file for complete search history.

(56) References Cited

U.S. PATENT DOCUMENTS 5,557,373 A * 9/1996 Miyashita et al.
5,873,019 A * 2/1999 Mizuishi
5,978,616 A * 11/1999 Shin ..... 399/50
6,014,532 A * 1/2000 Takeichi et al. ..... 399/71
6,029,029 A * 2/2000 Danzuka ..... 399/100
2004/0213600 A1* 10/2004 Watanabe et al. ..... 399/159
2005/0019070 A1 1/2005 Suda et al.
2005/0047804 A1* 3/2005 Kosuge ..... 399/27

FOREIGN PATENT DOCUMENTS

| | | |
|---|---|---|
| JP | 7-219313 | 8/1995 |
| JP | 11-143309 | 5/1999 |
| JP | 2002-244485 | 8/2002 |
| JP | 2002-341695 | 11/2002 |
| JP | 2005-18047 A | 1/2005 |
| JP | 2005-189509 | 7/2005 |
| JP | 2005-266138 | 9/2005 |
| JP | 2006-163318 | 6/2006 |
| JP | 2006-251751 | 9/2006 |

* cited by examiner

*Primary Examiner*—David P Porta
*Assistant Examiner*—Milton Gonzalez
(74) *Attorney, Agent, or Firm*—Nixon & Vanderhye, PC

(57) ABSTRACT

Along a rotational direction of a photoreceptor, a cleaner unit for cleaning a surface of the photoreceptor, a lubricant applying apparatus for applying a lubricant to the surface of the photoreceptor, and a charging device for charging the surface of the photoreceptor are disposed in this order. Further, the lubricant applying apparatus applies the lubricant to the surface of the photoreceptor which has been cleaned and has not been charged. As a result, it is possible to uniformly apply the lubricant to the surface of the image carrier for an extended period of time with stability.

12 Claims, 3 Drawing Sheets

IMAGE FORMING APPARATUS, LUBRICANT APPLYING APPARATUS, CONTROL METHOD OF IMAGE FORMING APPARATUS

This Nonprovisional application claims priority under 35 U.S.C. §119(a) on Patent Application No. 127058/2006 filed in Japan on Apr. 28, 2006, the entire contents of which are hereby incorporated by reference.

FIELD OF THE TECHNOLOGY

The present technology relates to (i) a lubricant applying apparatus for applying a lubricant to an image carrier provided on an electrophotographic image forming apparatus, (ii) an image forming apparatus, (iii) a control method of the image forming apparatus, (iv) a program, and (v) a storage medium of the program.

BACKGROUND OF THE TECHNOLOGY

In an electrophotograph scheme adopted in an image forming apparatus such as a copying machine and a laser printer, a surface of a photoreceptor (image carrier) is charged by a charging device, and then exposure is carried out by an exposing device so as to form an electrostatic latent image, and the electrostatic latent image is developed by a developing device, thereby forming a toner image. The toner image is electrostatically transferred to a transfer medium such as a recording sheet or the like by a transfer device, and then the toner image transferred onto the recording sheet is fixed by a fixing apparatus, thereby forming an image on the recording sheet.

Incidentally, the electrophotographic image forming apparatus transfers a part of the toner image formed on the photoreceptor onto the recording sheet in a transfer step, but rest of the toner remains on the surface of the photoreceptor also after the transfer step. Thus, if the toner remaining on the photoreceptor is left, image quality drops in subsequent image formation. Therefore, the electrophotographic image forming apparatus includes a cleaning device for removing the toner remaining on the photoreceptor. As the cleaning device, a device having a contact member (blade, brush, and the like) which comes into contact with the photoreceptor is widely used.

Further, there is proposed the following technique: A lubricant is applied to the surface of the photoreceptor so as to drop surface energy of the photoreceptor so that toner less adheres to the surface of the photoreceptor, which allows toner to be more easily cleaned and reduces a friction coefficient between the photoreceptor and the cleaning device, thereby less eroding a film of the photoreceptor (for example, see Patent Document 1: Japanese Unexamined Patent Publication No. 189509/2005 (Tokukai 2005-189509)(Publication date: Jul. 14, 2005)).

However, according to the technique of Patent Document 1, the lubricant is applied to the image carrier before the toner remaining on the image carrier reaches the cleaning device, that is, the lubricant is applied to the image carrier from which the remaining toner has not been cleaned by the cleaning device. Thus, the toner adheres to the lubricant applying means, so that it is difficult to uniformly apply the lubricant to the surface of the image carrier in a stable manner for an extended period of time.

Further, according to the technique of Patent Document 1, the lubricant and a lubricant supply brush are disposed in the cleaning device, so that the toner removed from the surface of the image carrier by the cleaning device may taint the lubricant and the lubricant supply brush. In this case, it is more difficult to uniformly apply the lubricant in a stable manner.

Further, according to the technique of patent Document 1, a large part of the lubricant applied to the surface of the image carrier is removed as well as the toner, so that the lubricant is less efficiently applied, which results in greater consumption of the lubricant.

SUMMARY OF THE TECHNOLOGY

The present technology was made in view of the foregoing problems, and to provide an image forming apparatus, a lubricant applying apparatus, a control method of the image forming apparatus, a program, and a storage medium of the program, each of which allows a lubricant to be uniformly applied to a surface of a photoreceptor in a stable manner for an extended period of time and less consumes the lubricant.

In order to solve the foregoing problems, an image forming apparatus includes: an image carrier; a charging section for charging the image carrier; a latent image forming section for forming an electrostatic latent image on the image carrier that has been charged; a developing section for developing the electrostatic latent image, formed on the image carrier, with a developer; a transfer section for transferring an image, obtained by developing the electrostatic latent image on the image carrier, onto a transfer medium; a cleaning section for cleaning a surface of the image carrier after transferring the image; and a lubricant applying section for applying a lubricant to the surface of the image carrier, wherein: the lubricant applying section applies the lubricant to the surface of the image carrier which has been cleaned and has not been charged, and the charging section includes (i) a contact charging member which comes into contact with the image carrier so as to charge the image carrier and (ii) a cleaning member which comes into contact with a surface of the contact charging member so as to clean the surface of the contact charging member. Note that, the transfer medium may be a recording material such as a recording sheet or the like or may be an intermediate transfer medium such as an intermediate transfer belt for transporting a developed image (toner image) to the recording material.

According to the arrangement, the lubricant applying section applies the lubricant to the surface of the image carrier which has been cleaned and has not been charged. That is, the lubricant is applied on the downstream side of the cleaning section in a rotational direction of the image carrier. Thus, it is possible to prevent the used toner from adhering to the lubricant applying section, so that it is possible to uniformly apply the lubricant to the surface of the image carrier for an extended period of time with stability. Further, the lubricant applied to the image carrier is not removed by the cleaning section right after the application, so that it is possible to more efficiently use the lubricant, thereby reducing consumption of the lubricant.

Further, there is provided the contact charging member which comes into contact with the image carrier so as to charge the image carrier, so that the contact charging member can uniformise the lubricant applied to the image carrier by the lubricant applying section. Thus, it is possible to uniformly apply the lubricant to the surface of the image carrier.

If an amount of the lubricant applied to the surface of the contact charging member is excessively large, electric charge leaks between the image carrier and the contact charging member, which may drop the charging performance or may result in a low quality image. However, according to the foregoing arrangement, the cleaning member removes unnecessary lubricant adhering to the surface of the contact charging member, so that it is possible to optimize the amount of the lubricant on the surface of the contact charging member. Also, the cleaning member uniformises the lubricant on the surface of the contact charging member, so that it is possible to prevent the electric charge leak from dropping the charging performance and prevent quality of an image from dropping.

Another image forming apparatus includes: an image carrier; a charging section for charging the image carrier; a latent image forming section for forming an electrostatic latent image on the image carrier that has been charged; a developing section for developing the electrostatic latent image, formed on the image carrier, with a developer; a transfer section for transferring an image, obtained by developing the electrostatic latent image on the image carrier, onto a transfer medium; and a lubricant applying section for applying a lubricant to the surface of the image carrier, wherein: the charging section includes (1) a contact charging member which comes into contact with the image carrier so as to charge the image carrier, (2) a cleaning member which comes into contact with a surface of the contact charging member so as to clean the surface of the contact charging member, and (3) a first contact/separation section for switching a position of the cleaning member between a position where the cleaning member comes into contact with the contact charging member and a position where the cleaning member is separated away from the contact charging member, and the lubricant applying section includes (I) a lubricant holding section for holding the lubricant in a solid phase, (II) an applying member for carrying a part of the lubricant held by the lubricant holding section to the surface of the image carrier so as to apply the part of the lubricant to the surface of the image carrier, and (III) a second contact/separation section for switching a position of the lubricant held by the lubricant holding section between a position where the lubricant comes into contact with the applying member and a position where the lubricant is separated away from the applying member.

According to the arrangement, the cleaning member removes unnecessary lubricant adhering to the surface of the contact charging member, so that it is possible to optimize the amount of the lubricant on the surface of the contact charging member. Also, the cleaning member uniformises the lubricant on the surface of the contact charging member. Further, when it is not necessary to clean the surface of the contact charging member, the cleaning member is separated away from the contact charging member, thereby suppressing abrasion of the contact charging member.

A lubricant applying apparatus applies a lubricant to a surface of an image carrier for carrying a toner image, said lubricant applying apparatus including: a lubricant holding section for holding the lubricant in a solid phase; an applying section for carrying a part of the lubricant held by the lubricant holding section to the surface of the image carrier so as to apply the part of the lubricant to the surface of the image carrier; a second contact/separation section for switching a position of the lubricant held by the lubricant holding section between a position where the lubricant comes into contact with the applying section and a position where the lubricant is separated away from the applying section; and a control section for controlling operation of the second contact/separation section, wherein the control section controls the operation of the second contact/separation section so that a period during which the lubricant is kept in contact with the applying section increases as a remaining amount of the lubricant held by the lubricant holding section decreases.

According to the arrangement, the position of the lubricant held by the lubricant holding section can be switched between a position where the lubricant is brought into contact with the applying member by the second contact/separation section and a position where the lubricant is separated away from the applying section. As a result, it is possible to optimize the amount of the lubricant applied to the image carrier via the applying section, and it is possible to reduce consumption of the lubricant.

Further, the control section controls the operation of the second contact/separation section, so that it is possible to optimize the amount of the lubricant applied to the image carrier via the applying section, thereby reducing consumption of the lubricant. Further, it is not necessary for the user to operate the second contact/separation section, so that it is possible to improve the usability for the user.

Further, the control section controls operation of the second contact/separation section, wherein the control section controls the operation of the second contact-separation section so that a period during which the lubricant is kept in contact with the applying section increases as a remaining amount of the lubricant held by the lubricant holding section decreases. As a result, it is possible to stabilize the amount of the lubricant applied to the image carrier for an extended period of time regardless of a remaining amount of the lubricant.

A control method for controlling an image forming apparatus which includes: an image carrier for carrying a toner image; and a lubricant applying section for applying a lubricant to a surface of the image carrier, said lubricant applying section including: a lubricant holding section for holding the lubricant in a solid phase; an applying member for carrying a part of the lubricant held by the lubricant holding section to the surface of the image carrier so as to apply the part of the lubricant to the surface of the image carrier; and a second contact/separation section for switching a position of the lubricant held by the lubricant holding section between a position where the lubricant comes into contact with the applying member and a position where the lubricant is separated away from the applying member, said control method includes the step of setting a period during which the lubricant is kept in contact with the applying section to be longer as a remaining amount of the lubricant held by the lubricant holding section decreases.

According to the method, it is possible to stabilize the amount of the lubricant applied to the image carrier for an extended period of time regardless of the remaining amount of the lubricant.

Another control method for controlling an image forming apparatus which includes: an image carrier for carrying a toner image; and a lubricant applying section for applying a lubricant to a surface of the image carrier, said lubricant applying section including: a lubricant holding section for holding the lubricant in a solid phase; an applying member for carrying a part of the lubricant held by the lubricant holding section to the surface of the image carrier so as to apply the part of the lubricant to the surface of the image carrier; and a second contact/separation section for switching a position of the lubricant held by the lubricant holding section between a position where the lubricant comes into contact with the applying member and a position where the lubricant is separated away from the applying member, said control method including the step of setting a period during which the lubricant is kept in contact with the applying member to be longer as a print density of an image to be formed is higher.

According to the method, the amount of the lubricant applied to the image carrier is controlled in accordance with a print density of an image to be formed, so that it is possible to stably reduce the toner adhering to the image carrier and it is possible to more efficiently use the lubricant, thereby reducing the consumption of the lubricant.

Still another control method for controlling an image forming apparatus which includes: an image carrier; a charging section for charging the image carrier; a latent image forming section for forming an electrostatic latent image on the image carrier that has been charged; a developing section for developing the electrostatic latent image, formed on the image carrier, with a developer; a transfer section for transferring an image, obtained by developing the electrostatic latent image on the image carrier, onto a transfer medium; and a lubricant applying section for applying a lubricant to the surface of the image carrier, said charging section including (1) a contact charging member which comes into contact with the image carrier so as to charge the image carrier, (2) a cleaning member which comes into contact with a surface of the contact charging member so as to clean the surface of the contact charging member, and (3) a first contact/separation section for switching a position of the cleaning member between a position where the cleaning member comes into contact with the contact charging member and a position where the cleaning member is separated away from the contact charging member, said lubricant applying section including (I) a lubricant holding section for holding the lubricant in a solid phase, (II) an applying member for carrying a part of the lubricant held by the lubricant holding section to the surface of the image carrier so as to apply the part of the lubricant to the surface of the image carrier, and (III) a second contact/separation section for switching a position of the lubricant held by the lubricant holding section between a position where the lubricant comes into contact with the applying member and a position where the lubricant is separated away from the applying member, said control method including the step of controlling the second contact/separation section so as to bring the lubricant into contact with the applying member and then controlling the operation of the first contact/separation section so as to bring the cleaning member and the contact charging member into contact with each other by the time the lubricant accordingly applied to the image carrier via the applying member reaches a counter portion opposite to the cleaning member and the contact charging member.

According to the method, the cleaning member is separated from the contact charging member when the lubricant is not applied to the image carrier, and the lubricant is brought into contact with the applying section and then the cleaning member is brought into contact with the contact charging member by the time the lubricant accordingly applied to the image carrier reaches a counter portion opposite to the cleaning member and the contact charging member. Thus, the cleaning member can uniformise the lubricant of the contact charging member, and it is possible to suppress abrasion of the contact charging member.

Note that, the control section may be realized by a computer. In this case, also a program causing the computer to function as the control section and a computer-readable storage medium having the program are included in the present technology.

Additional objects, features, and strengths will be made clear by the description below. Further, the advantages will be evident from the following explanation in reference to the drawings.

DESCRIPTION OF THE EMBODIMENTS

The following description will explain one embodiment of the present technology.

Figure 2:
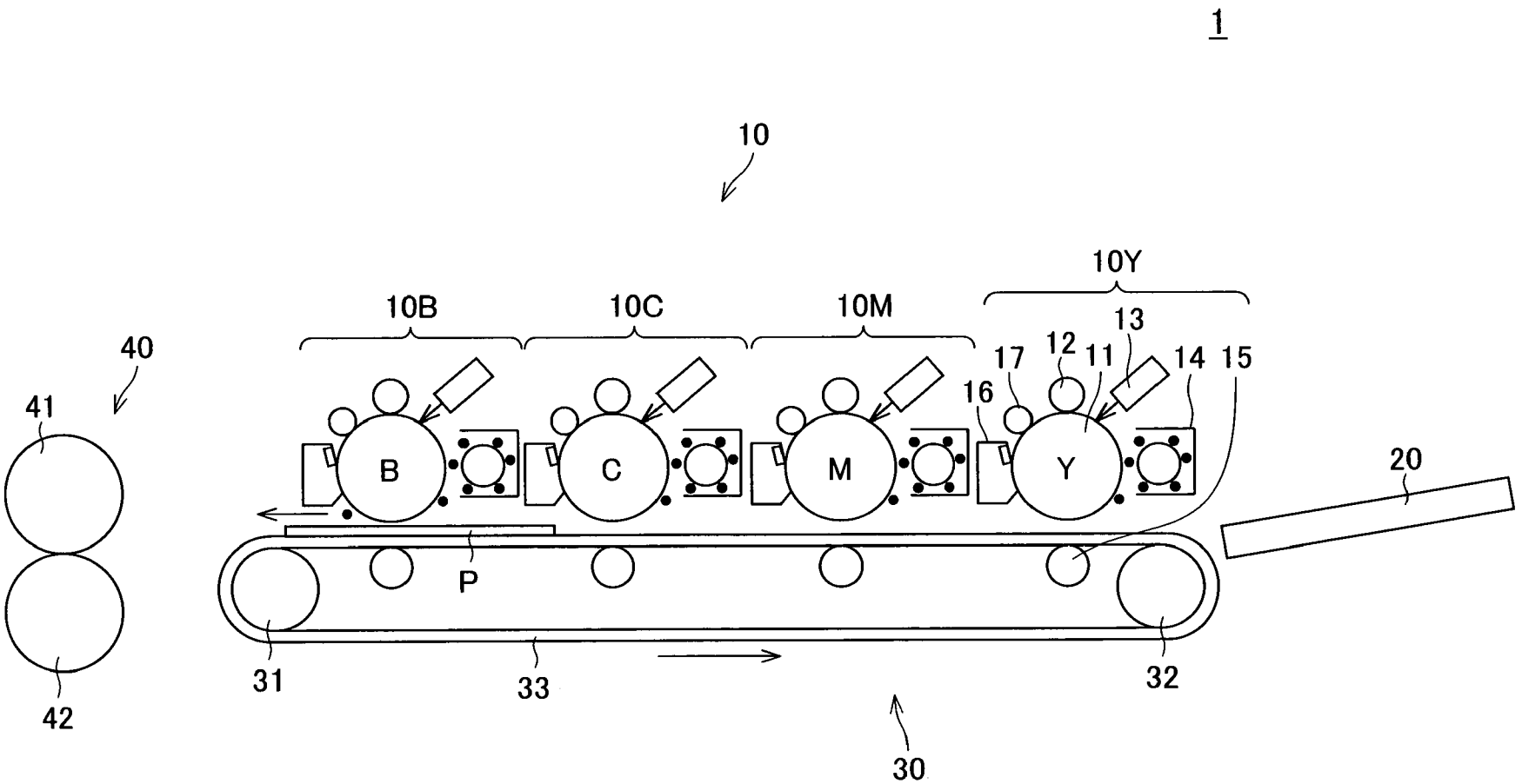
FIG. 2 is an explanatory drawing schematically illustrating an arrangement of the image forming apparatus according to one embodiment.

FIG. 2 is an explanatory drawing schematically illustrating an arrangement of an image forming apparatus 1 according to the present embodiment. The image forming apparatus 1 is an electrophotographic image forming apparatus and forms a multicolor or monochrome image on a recording sheet (transfer medium) in accordance with image data sent from the outside via a network or image data scanned by an image scanning apparatus (not shown) and the like for example.

As illustrated in FIG. 2, the image forming apparatus 1 includes a visible image forming unit 10, a recording sheet transport section 30, a fixing apparatus 40, and a supply tray 20.

In the visible image forming unit 10, four visible image forming units 10Y, 10M, 10C, and 10B are provided side by side so as to respectively correspond to yellow (Y), magenta (M), cyan (C), and black (B). That is, the visible image forming unit 10 includes four visible image forming units 10Y, 10M, 10C, and 10B, wherein the visible image forming unit 10Y forms an image by using yellow (Y) toner, the visible image forming unit 10M forms an image by using magenta (M) toner, the visible image forming unit 10C forms an image by using cyan (C) toner, and the visible image forming unit 10B forms an image by using black (B) toner. Specific arrangement thereof is as follows: four visible image forming units 10Y, 10M, 10C, and 10B are disposed along a transport path which allows the recording sheet to be transported from the supply tray 20 to the fixing apparatus 40 so as to perform multilayer transfer of yellow toner, magenta toner, cyan toner, and black toner, with respect to the transported recording sheet.

Figure 1:
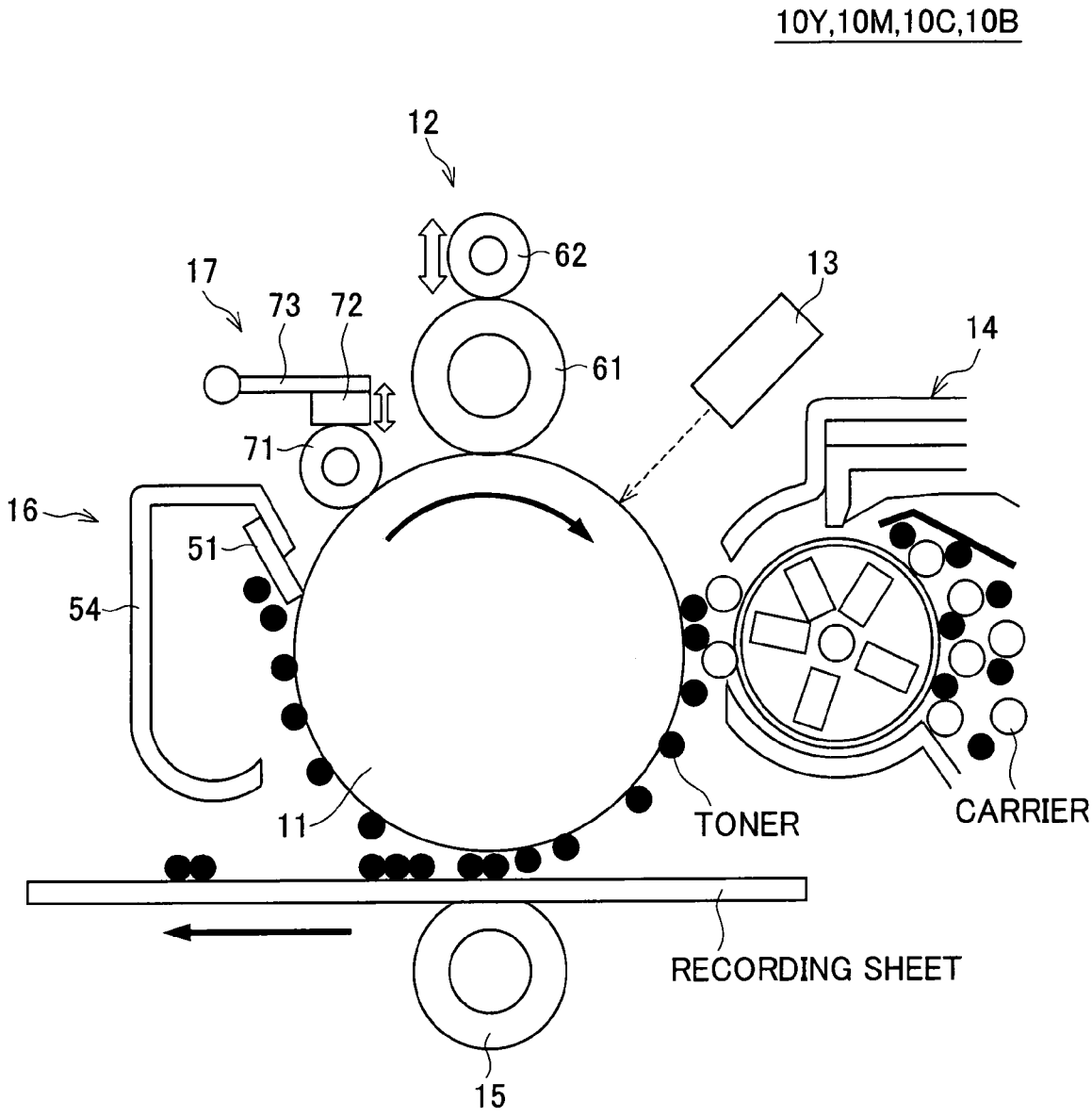
FIG. 1 is a cross sectional view illustrating an arrangement of a visible image forming unit provided on an image forming apparatus according to one embodiment.

FIG. 1 is a cross sectional view illustrating the arrangement of the visible image forming units 10Y, 10M, 10C, and 10B. As illustrated in FIG. 1, the visible image forming units 10Y, 10M, 10C, and 10B are arranged substantially in the same manner. That is, each visible image forming unit includes a photoreceptor (photoreceptor drum, image carrier) 11, a charging device 12, a laser beam irradiation section 13, a developing device 14, a transfer roller 15, a cleaner unit 16, and a lubricant applying apparatus 17.

The charging device 12 uniformly charges a surface of the photoreceptor 11 so as to have a predetermined potential. The present embodiment uses, as the charging device 12, a contact type charging device whose charging roller is brought into contact with the surface of the photoreceptor 11 so as to charge the surface of the photoreceptor 11. Note that, the charging device 12 will be detailed later.

The laser irradiation section 13 exposes the surface of the photoreceptor 11 charged by the charging device 12 in accordance with image data so as to form an electrostatic latent image on the surface of the photoreceptor 11. The developing device 14 develops the electrostatic latent image formed on the surface of the photoreceptor 11 so as to form a toner image. A bias voltage whose polarity is opposite to the toner is applied to the transfer roller 15, and the transfer roller 15 transfers the toner image formed on the photoreceptor 11 onto the recording sheet transported by the recording sheet transport section 30.

The cleaner unit 16 removes and collects toner remaining on the surface of the photoreceptor 11 after the transfer process carried out by the transfer roller 15. As illustrated in FIG. 1, the cleaner unit 16 includes a case 54 and a blade (cleaning blade) 51.

The blade 51 is used to collect the toner remaining on the surface of the photoreceptor 11 and is constituted of a long rubber member whose longer side direction corresponds to an axial direction of the photoreceptor 11. Examples of the rubber member constituting the blade 51 include urethane rubber, silicone rubber, chloroprene rubber, butadiene rubber, and the like. A long side of the blade 51 is provided on an opening of the case 54 so as to be positioned on a downstream side of the photoreceptor 11 in its rotational direction, and the other long side of the blade 51 is disposed so that its edge is in contact with the surface of the photoreceptor 11. As a result, the blade 51 blocks the toner remaining on the surface of the photoreceptor 11 at a contact portion between the blade 51 and the photoreceptor 11 after transferring the toner, and scratches the toner while carrying out a stick-slip operation, thereby removing the toner. The stick-slip operation is such that: the contact portion between the blade 51 and the photoreceptor 11 repeatedly carries out (i) an operation in which the contact portion of the blade 51 moves in the rotational direction of the photoreceptor in response to movement of the surface of the photoreceptor 11 and (ii) an operation in which the contact portion of the blade 51 returns to its original position due to its elasticity. In this manner, the edge of the blade 51 slides on the surface of the photoreceptor 11.

The lubricant applying apparatus 17 applies a lubricant to the surface of the photoreceptor 11 which has been cleaned by the cleaner unit 16 and has not been charged by the charging device 12. The lubricant applying apparatus 17 will be detailed later.

According to the foregoing arrangement, in each visible image forming unit, the charging device 12 charges the surface of the photoreceptor 11, and the laser beam irradiation section 13 exposes the surface of the photoreceptor 11 so as to form an electrostatic latent image, and the developing device 14 develops the electrostatic latent image, and the transfer roller 15 transfers the toner image onto the recording sheet. Further, the cleaner unit 16 removes and collects the toner remaining on the photoreceptor 11 after the transfer process. This transfer of the toner image onto the recording sheet is sequentially carried out by the visible image forming units for respective colors, thereby carrying out multicolor transfer of the toner image having respective colors onto the recording sheet.

The recording sheet transport section 30 includes a driving roller 31, an idling roller 32, and a transport belt 33, and transports the recording sheet so that the visible image forming units transfer the toner images onto the recording sheet. The driving roller 31 and the idling roller 32 suspend an endless transport belt 33. The driving roller 31 is driven so as to rotate at a predetermined peripheral speed, thereby rotating the transport belt 33. Further, an outside surface of the transport belt 33 is charged so as to have a predetermined potential, so that the recording sheet is electrostatically adsorbed to the transport belt 33. In this manner, the recording sheet is transported.

The recording sheet, transported by the recording sheet transport section 30 and passing through the visible image forming units, to which the toner image (unfixed toner image) has been transferred, is stripped from the transport belt 33 due to a curvature of the driving roller 31 so as to be transported to the fixing apparatus 40. The fixing apparatus 40 provides suitable heat and pressure to the recording sheet and fuses the toner transferred to the recording sheet so as to fix the toner on the recording sheet, and then delivers the recording sheet to a delivery tray (not shown). An arrangement of the fixing apparatus 40 is not particularly limited. For example, the fixing apparatus 40 may be arranged so as to include a heating roller 40 and a pressure roller 41 so that both the rollers sandwich the recording sheet so as to transport the recording sheet.

Note that, operations of the members included in the image forming apparatus 1 are controlled by a main control section (a control integrated circuit substrate or a computer: not shown).

Figure 3:
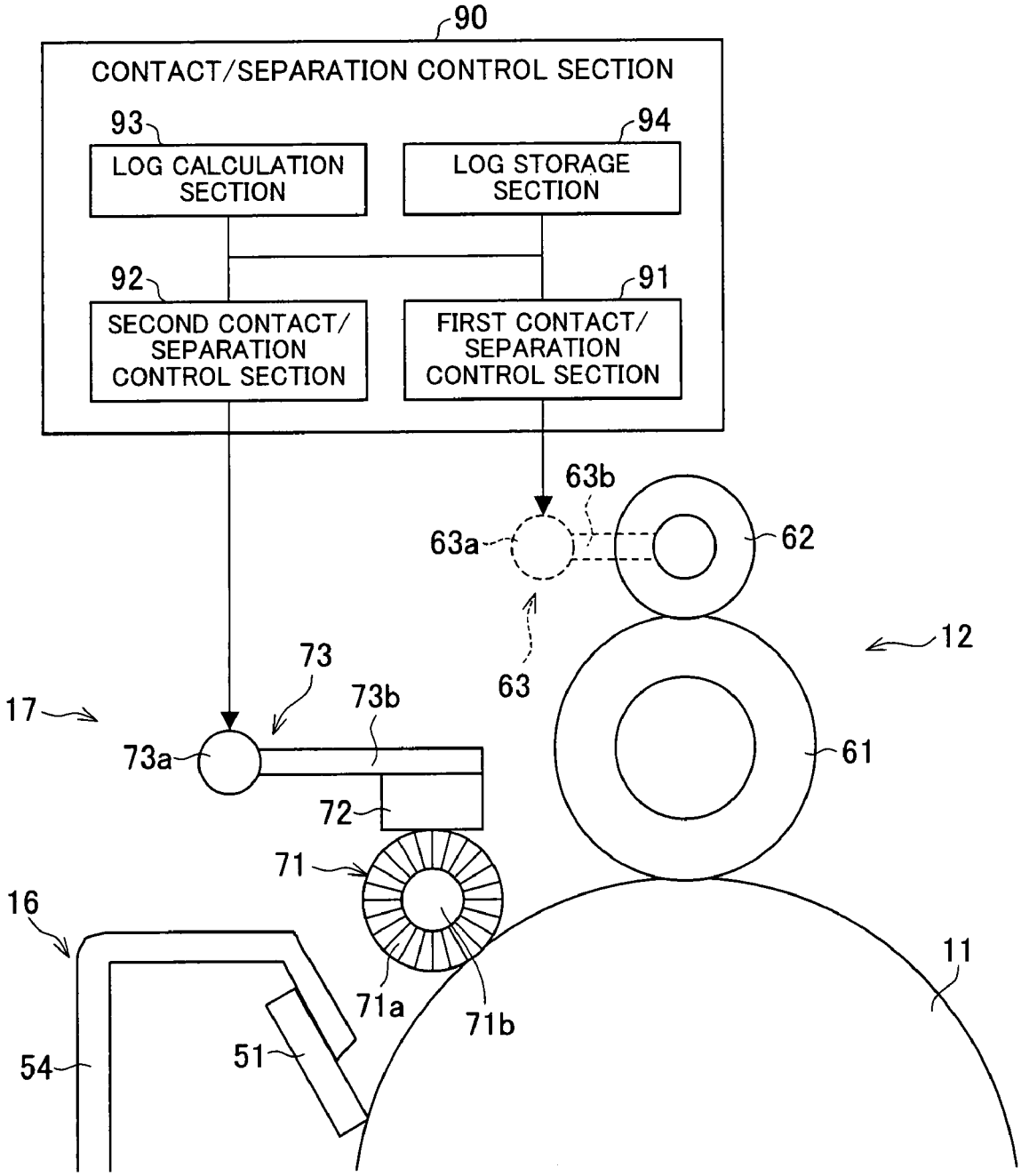
FIG. 3 is an enlarged view of a lubricant applying apparatus and a vicinity of a charging device in the visible image forming unit illustrated in FIG. 1.

Next, an arrangement of the lubricant applying apparatus 17 and the charging device 12 is described as follows with reference to FIG. 3. FIG. 3 is an enlarged view of peripheral portions of the lubricant applying apparatus 17 and the charging device 12.

First, the lubricant applying apparatus 17 is described. As illustrated in FIG. 3, the lubricant applying apparatus 17 includes a brush roller 71, a lubricant 72, and a contact/separation mechanism 73.

The brush roller 71 is a cylindrical brush whose length (width) is substantially the same as the photoreceptor 11, and the brush roller 71 is disposed so that its axis and an axis of the photoreceptor 11 are parallel to each other with a tip of the brush being in contact with the surface of the photoreceptor 11. Specifically, in the present embodiment, a conductive nylon brush (its electric resistance value is 7.5 Ω·cm) 71*a* whose girth is 2 denier is provided on a stainless shaft 71*a* whose diameter is 6 mm so that the brush has an external diameter of 16 mm in a diameter direction of the stainless shaft 71*b* with its density being 6×104 hairs/inch$^2$.

Note that, the brush 71 is rotated by driving means such as a motor, a gear, and the like. As a result, the brush roller 71 scratches not the contact portion of the photoreceptor 11 but a part of the lubricant 72 disposed on the upstream side of the brush in its rotational direction, and applies the scratched lubricant to the surface of the photoreceptor 11. Note that, the lubricant scratched by the brush roller 71 becomes fine particles so as to be supplied to the surface of the photoreceptor 11.

The lubricant (solid lubricant) 72 is applied to the surface of the photoreceptor 11 by the brush roller 71 and has a rectangular shape whose length (width) in its longer side direction is substantially the same as the photoreceptor 11. The lubricant 72 is provided on a lubricant holding section (hereinafter referred to as arm section 73*b*) of the contact/separation mechanism 73, and the contact/separation mechanism 73 allows switch between a position where the lubricant 72 comes into contact with the brush roller 71 and a position where the lubricant 72 is separated away from the brush roller 71. Note that, in the present embodiment, in case where the lubricant 72 is positioned so as to be brought into contact with the brush roller 71 by the contact/separation mechanism 73, weights of the lubricant 72 and an arm section 73*b* provided on the contact/separation mechanism 73 cause the lubricant 72 to come into contact with the brush roller 71. However, the arrangement is not limited to this. For example, it may be so arranged that: pushing means (not shown) such as a spring for pushing the lubricant 72 toward the brush roller 71 is provided on a part of the contact/separation mechanism 73 so that the pushing means presses the lubricant 72 against the brush roller 71.

In the present embodiment, zinc stearate (ZnSt) is used as the lubricant 72. However, the lubricant 72 is not limited to this. For example, it is possible to use other fatty metallic salt known as metallic soap, fluorine resin, or the like. Examples of the fatty metallic salt include not only the zinc stearate but also barium stearate, lead stearate, iron stearate, nickel stearate, cobalt stearate, copper stearate, strontium stearate, calcium stearate, cadmium stearate, magnesium stearate, zinc oleate, manganese oleate, iron oleate, cobalt oleate, zinc oleate, magnesium oleate, copper oleate, zinc palmitate, cobalt palmitate, copper palmitate, magnesium palmitate, aluminum palmitate, calcium palmitate, lead caprylate, lead caproate, zinc linolenate, cobalt linolenate, calcium linolenate, cadmium linolenate, and the like. Note that, moisture contained in the lubricant 72 has influence on the performance for charging the photoreceptor 11, so that it is preferable to use the lubricant 72 whose moisture content is 0.5% or less.

The contact/separation mechanism 73 includes a driving axis 73*a* and the arm section 73*b* as illustrated in FIG. 3, and the contact/separation mechanism 73 allows switch between a position where the lubricant 72 comes into contact with the brush roller 71 and a position where the lubricant 72 is separated away from the brush roller 71.

One end of the arm section 73*b* is fixed on the driving axis 73*a*, and the lubricant 72 is provided on the vicinity of the other end of the arm section 73*b*. The driving axis 73*a* is rotated at a predetermined angle by a driving force supplied from a driving source such as a motor and a gear (not shown). Note that, contact/separation of the lubricant 72 is controlled by a below-described contact/separation control section 90.

Note that, an arrangement of the contact/separation mechanism 73 is not limited to this as long as it is possible to allow switch between a position where the lubricant 72 comes into contact with the brush roller 71 and a position where the lubricant 72 is separated away from the brush roller 71. For example, the contact/separation mechanism 73 may be arranged so that: the arm section 73*b* is rotatably supported and an eccentric cam is in contact with a part of the arm section 73*b* so as to control rotation of the eccentric cam, thereby switching the position of the lubricant 72. Further, the contact/separation mechanism 73 may be arranged so that an actuator constituted of a solenoid or the like is used to switch the position of the lubricant 72.

Next, an arrangement of the charging device 12 is described. As illustrated in FIG. 3, the charging device 12 includes a charging roller (contact charging member) 61, a cleaning roller (cleaning member) 62, and a contact/separation mechanism 63.

The charging roller 61 has a length substantially equal to the axial length of the photoreceptor 11, and is positioned so that its axis and the axis of the photoreceptor 11 are parallel to each other so as to come into contact with the surface of the photoreceptor 11, and a high voltage power supply (not shown) supplies power to the charging roller 61 so as to uniformly charge the surface of the photoreceptor 11. Note that, the charging roller 61 is rotated by the photoreceptor 11.

The charging roller 61 has an elastic layer on its external surface with a conductive supporter serving as a base material thereof, and a resistance layer is formed on the elastic layer. An example of a round bar made of metal material such as iron, copper, stainless, aluminum, nickel, and the like. Note that, in order to provide anti-rust and anti-flaw property, a plating treatment may be carried out with respect to the metal surface. However, it is necessary not to lose the conductivity.

The elastic layer has suitable conductivity and elasticity in order to favorably supply power to the photoreceptor 11 serving as a charged member and in order to favorably keep the charging roller 61 and the photoreceptor 11 in tightly contact with each other.

Specifically, the elastic layer is made of, for example, synthetic rubber such as natural rubber, ethylenepropylene rubber (EPDM), stylenebutadiene rubber (SBR), silicone rubber, urethane rubber, epichlorohydrin rubber, isoprene rubber (IR), butadiene rubber (BR), nitryl butadiene rubber (NBR), chloroprene rubber, and the like, or the elastic layer may be obtained by suitably adding (i) a conductive agent allowing electron conduction, e.g., carbon black, graphite, conductive metal oxide, and the like, (ii) a conductive agent allowing ion conduction, e.g., alkaline metal salt, quaternary ammonium salt, and the like, into an elastic material such as polyamide resin, polyurethane resin, silicone resin, and the like. Note that, in order to keep the charging roller 61 and the photoreceptor 11 in tightly contact with each other, it is preferable to grind the elastic layer so that its central portion is widest and the elastic layer becomes narrower from the central portion to both the ends (i.e., a crown shape).

The resistance layer is formed in contact with the elastic layer so as to prevent an emollient oil, an elasticizer, and the like, contained in the elastic layer from bleeding out at the surface of the charging roller 61 and so as to adjust an electric resistance of the whole charging roller 61. The resistance layer is made of a material having conductivity and semiconductivity. Examples thereof include epichlorohydrin rubber, NBR, polyolefine thermoplastic elastomer, urethane thermoplastic elastomer, polystylene thermoplastic elastomer, fluorinated rubber thermoplastic elastomer, polyester thermoplastic elastomer, polyamide thermoplastic elastomer, polybutadiene thermoplastic elastomer, ethylene-vinyl acetate thermoplastic elastomer, polyvinylchloride thermoplastic elastomer, chlorinated polyethylene thermoplastic elastomer. Alternatively, it is possible to obtain the elastic layer by suitably adding a conductive agent allowing electron conduction (for example, conductive carbon, graphite, conductive metal oxide, copper, aluminum, nickel, iron powder) and a conductive agent allowing ion conduction (for example, alkali metal salt, ammonium salt, and the like) to a mixture of the foregoing materials or a material made of copolymer. In this case, in order to obtain desired electric resistance, two or more kinds of the foregoing conductive agents may used together. However, in view of environmental change or taint on the photoreceptor 11, it is preferable to use the conductive agent having the electron conduction mechanism.

The cleaning roller 62 is disposed so as to be in contact with the surface of the charging roller 61 and removes toner, paper dusts, and the like, adhering to the surface of the charging roller 61. The cleaning roller 62 can be obtained, for example, by winding a felt, a sponge, or the like around an external peripheral face of a cylinder made of metal material such as iron, copper, stainless, aluminum, nickel, and the like. Note that, in the present embodiment, the cleaning roller 62 is used as the cleaning member, but the arrangement is not limited to this. The cleaning member may have a shape other than the roller shape. That is, the cleaning member may be arranged in any manner as long as the cleaning member can remove the lubricant, a taint, and the like, which adhere to the surface of the charging roller 61. For example, it is possible to adopt such an arrangement that a felt, a sponge, a mylar sheet, and the like are brought into contact with the surface of the charging roller 61.

The contact/separation mechanism 63 allows switch between a position where the cleaning roller (cleaning member) 62 comes into contact with the charging roller and a position where the cleaning roller 62 is separated away from the charging roller 61. As illustrated in FIG. 3, the contact/separation mechanism 63 includes a driving axis 63*a* and an arm section 63*b*.

One end of the arm section 63*b* is fixed on the driving axis 63*a*, and the cleaning roller 62 is provided on parts (e.g., bearing sections axially supporting both the ends of the axis in a rotatable manner) of the other end of the arm section 63*b*. The driving axis 63*a* is rotated at a predetermined angle by a driving force supplied from a driving source such as a motor, a gear, and the like (not shown). As a result, the position of the cleaning roller 62 is switched between the position where the cleaning roller 62 comes into contact with the charging roller 61 and the position where the cleaning roller 62 is separated away from the charging roller 61. Contact/separation of the cleaning roller 62 is controlled by a below-described contact/separation mechanism 90.

Note that, the arrangement of the contact/separation mechanism 63 is not limited to this as long as it is possible to switch the position of the cleaning roller 62 between the position where the cleaning roller 62 comes into contact with the charging roller 61 and the position where the cleaning roller 62 is separated away from the charging roller 61. For example, the contact/separation mechanism 63 may be arranged in the same manner as in the contact/separation mechanism 73 so that an eccentric cam or an actuator constituted of a solenoid or the like is used.

Next, the following description explains (i) an arrangement of the contact/separation control section 90 for controlling contact/separation of the lubricant 72 and the cleaning roller 62 and (ii) a method for controlling the contact/separation.

The contact/separation control section 90 includes a first contact/separation control section 91, a second contact/separation control section 92, a log calculation section 93, and a log storage section 94. Note that, the contact/separation control section 90 may be provided on a main control section of the image forming apparatus 1.

The first contact/separation control section 91 controls operation of the contact/separation mechanism 63, that is, the first contact/separation control section 91 controls a condition under which the cleaning roller 62 is brought into contact with or separated away from the charging roller 61.

The second contact/separation control section 92 controls operation of the contact/separation mechanism 73, that is, the second contact/separation control section 92 controls a condition under which the lubricant 72 is brought into contact with or separated away from the brush roller 71.

The log calculation section 93 calculates log information (life information) from the time when the use of the currently used lubricant was started (at the time of shipment or at the time when the lubricant 72 was previously replaced) so as to store the log information into the log storage section 94. In the present embodiment, an accumulated travel distance of the photoreceptor 11 (a distance by which the surface of the photoreceptor 11 moves due to its rotation) is used as the log information.

The log information calculation section 93 calculates the accumulated travel distance of the photoreceptor 11 so as to update the log information stored in the log information storage section 94. The log information calculation section 93, for example, receives a driving control signal supplied from the main control section to the rotation driving means of the photoreceptor 11, and the log information calculation section 93 calculates the accumulated travel distance of the photoreceptor 11 in accordance with the driving control signal. Alternatively, the main control section may calculate the accumulated travel distance and output the accumulated travel distance to the log information calculation section 93.

Further, it may be so arranged that measuring means for measuring a rotation number or a rotational speed of the photoreceptor 11 is provided so as to calculate the accumulated travel distance in accordance with the measurement result.

Further, the second contact/separation control section 92 controls a contact/separation timing of the contact/separation mechanism 73 so that a constant amount of the lubricant 72 is applied, in accordance with the log information calculated by the log information calculation section 93 (or the log information stored in the log information storage section 94). Specifically, as illustrated in Table 1 for example, on the assumption that a cycle length of a single cycle made up of a contact period and a separation period is constant (40 seconds in Table 1), a ratio (duty) between the contact period and the separation period in each cycle is varied according to the accumulated travel distance, thereby making an amount of the applied lubricant (e.g., for each recording sheet) substantially constant.

TABLE 1

| Accumulated travel distance | Duty (%) | Contact period (second) | Separation period (second) | Amount of applied lubricant (μg/sheet) |
|---|---|---|---|---|
| 0 | 40 | 16 | 24 | 36 |
| 10000 | 48 | 19 | 21 | 36 |
| 20000 | 55 | 22 | 18 | 35 |
| 30000 | 61 | 24 | 16 | 36 |
| 40000 | 66 | 26 | 14 | 35 |
| 50000 | 70 | 28 | 12 | 35 |
| 60000 | 74 | 30 | 10 | 36 |
| 70000 | 77 | 31 | 9 | 35 |
| 80000 | 80 | 32 | 8 | 35 |
| 90000 | 83 | 33 | 7 | 36 |
| 100000 | 86 | 34 | 6 | 35 |
| 110000 | 88 | 35.2 | 4.8 | 35 |
| 120000 | 90 | 36 | 4 | 35 |
| 130000 | 92 | 36.8 | 3.2 | 36 |
| 140000 | 94 | 37.6 | 2.4 | 35 |
| 150000 | 96 | 38.4 | 1.6 | 35 |

Table 2 illustrates a relation between the accumulated travel distance of the photoreceptor 11 and the amount of the applied lubricant in case where the lubricant 72 is always in contact with the brush 71 (in case where the duty is 100%) (Comparative Example I). Further, Table 3 illustrates a relation between the accumulated travel distance of the photoreceptor 11 and the amount of the applied lubricant in case where a cycle length of each cycle is 40 seconds as in Table 1 and the duty is 50% (Comparative Example II).

TABLE 2

| Accumulated travel distance | Duty (%) | Contact period (second) | Separation period (second) | Amount of applied lubricant (μg/sheet) |
|---|---|---|---|---|
| 0 | 100 | 40 | 0 | 90 |
| 10000 | 100 | 40 | 0 | 70 |
| 20000 | 100 | 40 | 0 | 55 |
| 30000 | 100 | 40 | 0 | 45 |
| 40000 | 100 | 40 | 0 | 38 |
| 50000 | 100 | 40 | 0 | 33 |
| 60000 | 100 | 40 | 0 | 30 |
| 70000 | 100 | 40 | 0 | 27 |
| 80000 | 100 | 40 | 0 | 25 |
| 90000 | 100 | 40 | 0 | 24 |
| 100000 | 100 | 40 | 0 | 23 |
| 110000 | 100 | 40 | 0 | 23 |

TABLE 2-continued

| Accumulated travel distance | Duty (%) | Contact period (second) | Separation period (second) | Amount of applied lubricant (μg/sheet) |
|---|---|---|---|---|
| 120000 | 100 | 40 | 0 | 22 |
| 130000 | 100 | 40 | 0 | 22 |
| 140000 | 100 | 40 | 0 | 21 |
| 150000 | 100 | 40 | 0 | 21 |

TABLE 3

| Accumulated travel distance | Duty (%) | Contact period (second) | Separation period (second) | Amount of applied lubricant (μg/sheet) |
|---|---|---|---|---|
| 0 | 50 | 20 | 20 | 45 |
| 10000 | 50 | 20 | 20 | 37 |
| 20000 | 50 | 20 | 20 | 31 |
| 30000 | 50 | 20 | 20 | 26 |
| 40000 | 50 | 20 | 20 | 22 |
| 50000 | 50 | 20 | 20 | 20 |
| 60000 | 50 | 20 | 20 | 19 |
| 70000 | 50 | 20 | 20 | 18 |
| 80000 | 50 | 20 | 20 | 17 |
| 90000 | 50 | 20 | 20 | 17 |
| 100000 | 50 | 20 | 20 | 16 |
| 110000 | 50 | 20 | 20 | 16 |
| 120000 | 50 | 20 | 20 | 16 |
| 130000 | 50 | 20 | 20 | 15 |
| 140000 | 50 | 20 | 20 | 15 |
| 150000 | 50 | 20 | 20 | 15 |

As illustrated in Table 2 and Table 3, in case where the lubricant 72 is always in contact with the brush 71 and in case where both of them are in contact with each other at a certain duty, the amount of the applied lubricant decreases as the accumulated travel distance of the photoreceptor 11 increases. This is because: an amount of remaining lubricant 72 decrease as the accumulated travel distance of the photoreceptor 11 increases, which results in lower pressure exerted to the brush roller 71.

In the present embodiment, as illustrated in Table 1, the contact/separation timing is controlled so that the duty increases as the accumulated travel distance of the photoreceptor 11 increases (so that a rate of the contact period to the separation period increases), so that it is possible to make the amount of the applied lubricant substantially constant regardless of the accumulated travel distance of the photoreceptor 11.

The first contact/separation control section 91 controls operation of the contact/separation mechanism 63 so that the cleaning roller 62 and the charging roller 61 are in contact with each other until the lubricant applied to the photoreceptor 11 via the brush roller 71 due to contact between the lubricant 72 and the brush roller 71 reaches a counter portion opposite to the cleaning roller 62 and the charging roller 61. Further, the first contact/separation control section 91 controls the contact/separation mechanism 63 so that the cleaning roller 62 and the charging roller 61 are separated away from each other after the lubricant applied to the photoreceptor 11 via the brush roller 71 having been separated from the lubricant 72 right after contact between the lubricant 72 and the brush roller 71 reaches a counter portion opposite to the cleaning roller 62 and the charging roller 61.

As described above, the image forming apparatus 1 according to the present embodiment is arranged so that the lubricant is applied to the surface of the photoreceptor 11 which has been cleaned and has not been charged. Thus, the lubricant is applied to the surface of the photoreceptor 11 from which the toner has been removed by the cleaner unit 16, so that it is possible to prevent the toner from adhering to the brush roller 71, thereby uniformly applying the lubricant to the surface of the photoreceptor 11 for an extended period of time with stability. Further, the lubricant applied to the photoreceptor 11 is not removed by the cleaner unit 16 right after the application, so that it is possible to reduce consumption of the lubricant by more efficiently using the lubricant.

Further, the image forming apparatus 1 according to the present embodiment is arranged so that the contact type charging device 12 having the charging roller 61 is used. Thus, the lubricant applied to the photoreceptor 11 by the brush roller 71 can be made uniform by the charging roller 61. Thus, it is possible to uniformly apply the lubricant to the surface of the photoreceptor 11 for an extended period of time with stability.

Further, in the present embodiment, the contact/separation control section 90 controls operation of the contact/separation mechanism 63 so that a period in which the lubricant 72 is in contact with the brush roller 71 increases as the accumulated travel distance of the photoreceptor 11 increases. As a result, it is possible to stabilize the amount of the lubricant applied to the photoreceptor 11, regardless of a remaining amount of the lubricant 72, for an extended period of time.

That is, in the present embodiment, the lubricant 72 is in contact with the brush roller 71 due to its weight, so that a contact area or a contact pressure of the lubricant 72 with respect to the brush roller 71 decreases as the weight of the lubricant 72 decreases due to its smaller amount. Further, it may be so arranged that pushing means such as a spring presses the lubricant 72 against the brush roller 71. Also in this case, when the remaining amount of the lubricant 72 decreases, a length of the spring varies, so that the contact area or the contact pressure of the lubricant 72 with respect to the brush roller 71 decreases.

Thus, as described above, the lubricant 72 is kept in contact with the brush roller 71 for a longer period as the accumulated travel distance of the photoreceptor 11 increases, i.e., as the remaining amount of the lubricant decreases, thereby stabilizing the amount of the lubricant applied to the photoreceptor 11, regardless of the remaining amount of the lubricant 72, for an extended period of time.

Further, in the present embodiment, there is provided the cleaning roller 62 which comes into contact with the charging roller 61 so as to clean the surface of the charging roller 61.

Thus, the cleaning roller 62 removes an extra amount of the lubricant which has moved from the photoreceptor 11 to the charging roller 61 so as to optimize an amount of the lubricant on the surface of the charging roller 61 and so as to realize uniform application on the surface of the charging roller 61. Particularly, in the present embodiment, the lubricant is applied on the downstream side, in a rotational direction of the photoreceptor 11, with respect to the cleaning unit 16 for cleaning the surface of the photoreceptor 11. Thus, unlike a conventional arrangement in which the lubricant is applied on the upstream side of the cleaner unit, the lubricant on the surface of the photoreceptor 11 is not made uniform by the cleaning blade, so that a large amount of lubricant may be unevenly applied to the charging roller 61. However, the cleaning roller 62 optimizes and uniformises the amount of the lubricant on the surface of the charging roller 61.

Further, in the present embodiment, the cleaning roller 62 can be brought into contact with and separated away from the charging roller 61. Thus, it is possible to suppress abrasion of the charging roller 61 and toner taint of the cleaning roller 62.

Further, in the present embodiment, the cleaning roller 62 and the charging roller 61 are in contact with each other until the lubricant applied to the photoreceptor 11 via the brush roller 71 due to contact between the lubricant 72 and the brush roller 71 reaches a counter portion opposite to the cleaning roller 62 and the charging roller 61. Further, the first contact/separation control section 91 controls the contact/separation mechanism 63 so that the cleaning roller 62 and the charging roller 61 are separated away from each other after the lubricant applied to the photoreceptor 11 via the brush roller 71 having been separated from the lubricant 72 right after contact between the lubricant 72 and the brush roller 71 reaches the counter portion opposite to the cleaning roller 62 and the charging roller 61.

As a result, when there is a possibility that a large amount of lubricant may be applied to the charging roller 61, the cleaning roller 62 is brought into contact with the charging roller 61, thereby optimizing and uniformising an amount of the lubricant on the surface of the charging roller 61, so that it is possible to prevent troubles such as electric charge leak. Further, when there is no possibility that a large amount of lubricant may be applied to the charging roller 61, the cleaning roller 62 is separated away from the charging roller 61, thereby preventing abrasion and the like of the charging roller 61, so that it is possible to efficiently clean the charging roller 61.

Note that, in the present embodiment, the accumulated travel distance of the photoreceptor 11 (a distance by which the surface of the photoreceptor 11 moves due to its rotation) is used as the log information, but the log information is not limited to this as long as the information allows calculation or estimation of a remaining amount of the lubricant 72. For example, it is possible to use information indicative of (i) an accumulated rotation number of the photoreceptor 11, (ii) an accumulated number of times images are formed, (iii) an accumulated number of printed sheets, (iv) an accumulated number of times the contact/separation mechanism 73 bring the lubricant 72 into contact and separates away the lubricant 72, or (v) other use condition of the image forming apparatus 1 (a period during which the image forming apparatus 1 is used or a number of times the image forming apparatus 1 is used).

Further, in the present embodiment, as illustrated in Table 1, a cycle length of each cycle made up of a contact period and a separation period is constant, and a duty in each cycle is varied according to the accumulated travel distance, thereby having a substantially predetermined amount of the applied lubricant. However, the method for controlling the contact/separation timing is not limited to this as long as the amount of the applied lubricant is nearer to a predetermined amount.

For example, as illustrated in Table 4, it is possible to control the timing so that the contact period for each time is constant (20 second in Table 4) and the separation period is varied, thereby making the amount of the applied lubricant nearer to the predetermined amount.

TABLE 4

| Accumulated travel distance | Contact time (second | Separation time (second) | Amount of applied lubricant (μg/sheet) |
|---|---|---|---|
| 0 | 20 | 15.2 | 36 |
| 10000 | 20 | 10 | 35 |
| 20000 | 20 | 16.4 | 35 |

TABLE 4-continued

| Accumulated travel distance | Contact time (second | Separation time (second) | Amount of applied lubricant (μg/sheet) |
|---|---|---|---|
| 30000 | 20 | 8 | 35 |
| 40000 | 20 | 7 | 36 |
| 50000 | 20 | 17.6 | 35 |
| 60000 | 20 | 5 | 35 |
| 70000 | 20 | 4.5 | 35 |
| 80000 | 20 | 18.4 | 35 |
| 90000 | 20 | 3.5 | 35 |
| 100000 | 20 | 3 | 36 |
| 110000 | 20 | 2.5 | 35 |
| 120000 | 20 | 19.2 | 35 |
| 130000 | 20 | 1.5 | 35 |
| 140000 | 20 | 1 | 36 |
| 150000 | 20 | 1 | 35 |

Further, in the present embodiment, the timing of the contact/separation of the lubricant 72 and the brush roller 71 is controlled so that the amount of the lubricant applied to the photoreceptor 11 is constant, but the present technology is not limited to this arrangement.

For example, as an optimal amount of lubricant, an image which is densely printed requires a larger amount of lubricant than an image which is sparsely printed. Thus, the amount of the applied lubricant may be set according to how densely/sparsely an image is printed (according to a print density) at the time of image formation. For example, it may be so arranged that: a print density calculation section for calculating the print density in accordance with image data is provided on the contact/separation control section 90, and the image data is inputted from the main control section of the image forming apparatus 1 to the contact/separation control section 90, and the second contact/separation control section 92 sets a target amount of the applied lubricant in accordance with the print density concerning the image data which print density is calculated by the print density calculation section, and the contact/separation timing is controlled in accordance with the log information so as to realize the target amount of the applied lubricant.

Further, the present embodiment explained the arrangement in which the charging roller 61 is provided as the contact type charging member, but the arrangement of the contact charging member is not limited to this. For example, a brush type, a plate type, or a sheet type may be used. Further, instead of the cleaning roller 62, a cleaning member constituted of other type (e.g., a brush type, a plate type, a sheet type, and the like) of the charging member may be used.

Further, the present embodiment explained the arrangement in which an electrostatic latent image is formed on the photoreceptor (image carrier) 11, but the present technology is not limited to this arrangement. The present technology is applicable also to an arrangement in which an electrostatic latent image is formed on an image carrier for carrying a toner image, e.g., an intermediate transfer belt (transfer medium, intermediate transfer medium) and the like. Also in this case, the lubricant is applied between a cleaning region for collecting the toner from the image carrier and a charging region for charging the surface of the image carrier.

Further, the respective functions of the contact/separation control section 90 in the image forming apparatus 1 of the present embodiment are realized by software with use of a processor such as a CPU. That is, the contact/separation control section 90 includes: a CPU (central processing unit) for carrying out a command of a control program for realizing the functions; a ROM (read only memory) in which the program is stored; a RAM (random access memory) for developing the program; a storage device (storage medium), such as a memory, in which the program and various kinds of data are stored; and the like. Further, the object of the present technology can be achieved as follows: a storage medium for computer-readably storing a program code (an execute form program, intermediate code program, or source program) of the control program which is software for implementing the aforementioned functions is provided to the image forming apparatus 1, and a computer (or CPU and MPU) provided on the image forming apparatus 1 reads out the program code stored in the storage medium so as to implement the program, thereby achieving the object of the present technology.

Examples of the storage medium which satisfies these conditions include: tapes, such as magnetic tape and cassette tape; disks including magnetic disks, such as floppy disks (registered trademark) and hard disk, and optical disks, such as CD-ROMs, magnetic optical disks (MOs), mini disks (MDs), digital video disks (DVDs), and CD-Rs; cards, such as IC card (including memory cards) and optical cards; and semiconductor memories, such as mask ROMs, EPROMs, EEPROMs, and flash ROMs.

Further, it may be so arranged that: the image forming apparatus 1 is made connectable to communication networks, and the program code is supplied via the communication networks. The communication networks are not limited to a specific means. Specific examples of the communication network include Internet, intranet, extranet, LAN, ISDN, VAN, a CATV communication network, a virtual private network, a telephone line network, a mobile communication network, a satellite communication network, and the like. Further, a transmission medium constituting the communication network is not particularly limited. Specifically, it is possible to use a wired line such as a line in compliance with IEEE 1394 standard, a USB line, a power line, a cable TV line, a telephone line, an ADSL line, and the like, as the transmission medium. Further, it is possible to use (i) a wireless line utilizing an infrared ray used in IrDA and a remote controller, (ii) a wireless line which is in compliance with Bluetooth standard (registered trademark) or IEEE802.11 wireless standard, and (iii) a wireless line utilizing HDR, a mobile phone network, a satellite line, a ground wave digital network, and the like, as the transmission medium. Note that, the present technology can be realized by a computer data signal (data signal sequence) which is realized by electronic transmission of the program code and which is embedded in a carrier wave.

Further, the respective blocks of the contact/separation control section 90 of the present embodiment are not necessarily realized by software but may be constituted by hardware logic.

As described above, an image forming apparatus includes: an image carrier; a charging section for charging the image carrier; a latent image forming section for forming an electrostatic latent image on the image carrier that has been charged; a developing section for developing the electrostatic latent image, formed on the image carrier, with a developer; a transfer section for transferring an image, obtained by developing the electrostatic latent image on the image carrier, onto a transfer medium; a cleaning section for cleaning a surface of the image carrier after transferring the image; and a lubricant applying section for applying a lubricant to the surface of the image carrier, wherein: the lubricant applying section applies the lubricant to the surface of the image carrier which has been cleaned and has not been charged, and the charging section includes (i) a contact charging member which comes into contact with the image carrier so as to charge the image carrier and (ii) a cleaning member which comes into contact with a surface of the contact charging member so as to clean the surface of the contact charging member. Note that, the transfer medium may be a recording material such as a recording sheet or the like or may be an intermediate transfer medium such as an intermediate transfer belt for transporting a developed image (toner image) to the recording material.

According to the arrangement, the lubricant applying section applies the lubricant to the surface of the image carrier which has been cleaned and has not been charged. That is, the lubricant is applied on the downstream side of the cleaning section in a rotational direction of the image carrier. Thus, it is possible to prevent the used toner from adhering to the lubricant applying section, so that it is possible to uniformly apply the lubricant to the surface of the image carrier for an extended period of time with stability. Further, the lubricant applied to the image carrier is not removed by the cleaning section right after the application, so that it is possible to more efficiently use the lubricant, thereby reducing consumption of the lubricant.

Further, there is provided the contact charging member which comes into contact with the image carrier so as to charge the image carrier, so that the contact charging member can uniformise the lubricant applied to the image carrier by the lubricant applying section. Thus, it is possible to uniformly apply the lubricant to the surface of the image carrier.

Further, if an amount of the lubricant applied to the surface of the contact charging member is excessively large, electric charge leaks between the image carrier and the contact charging member, which may drop the charging performance or may result in a low quality image. However, according to the foregoing arrangement, the cleaning member removes unnecessary lubricant adhering to the surface of the contact charging member, so that it is possible to optimize the amount of the lubricant on the surface of the contact charging member. Also, the cleaning member uniformises the lubricant on the surface of the contact charging member, so that it is possible to prevent electric charge leak from dropping the charging performance and prevent quality of an image from dropping.

Further, the image forming apparatus may include a first contact/separation section for switching a position of the cleaning member between a position where the cleaning member comes into contact with the contact charging member and a position where the cleaning member is separated away from the contact charging member.

According to the arrangement, the cleaning member is separated away from the contact charging member when it is not necessary to clean the contact charging member, and the cleaning member is brought into contact with the contact charging member as necessary, so that it is possible to prevent the electric charge leak from dropping the charging performance, and it is possible to suppress abrasion of the contact charging member which is caused by the cleaning member.

Further, the image forming apparatus may be arranged so that the lubricant applying section includes: a lubricant holding section for holding the lubricant in a solid phase; an applying member for carrying a part of the lubricant held by the lubricant holding section to the surface of the image carrier so as to apply the part of the lubricant to the surface of the image carrier; and a second contact/separation section for switching a position of the lubricant held by the lubricant holding section between a position where the lubricant comes into contact with the applying member and a position where the lubricant is separated away from the applying member.

According to the arrangement, the second contact/separation section can switch a position of the lubricant held by the lubricant holding section between a position where the lubricant comes into contact with the applying member and a position where the lubricant is separated away from the applying member. As a result, it is possible to optimize the amount of the lubricant applied to the image carrier via the applying section, so that it is possible to reduce consumption of the lubricant.

Further, the image forming apparatus may include a control section for controlling operation of the second contact/separation section. According to the arrangement, the control section controls the operation of the second contact/separation section, so that it is possible to optimize the amount of the lubricant applied to the image carrier via the applying section, and it is possible to reduce consumption of the lubricant. Further, it is not necessary for the user to operate the second contact/separation section, so that it is possible to improve the usability for the user.

Further, the image forming apparatus may be arranged so that the control section controls the operation so that a period during which the lubricant is kept in contact with the applying member increases as a remaining amount of the lubricant held by the lubricant holding section decreases.

For example, according to an arrangement in which the lubricant is brought into contact with the applying section due to a weight of the lubricant itself, when a remaining amount of the lubricant becomes smaller which decreases the weight of the lubricant, a contact area or a pressure of the lubricant with respect to the applying section decreases, so that also the amount of the lubricant applied to the image carrier via the applying section decreases. Also according to an arrangement in which the lubricant is pressed against the applying section by a pushing section such as a spring, when the remaining amount of the lubricant becomes smaller, a length of the spring changes, so that the contact area or the pressure of the lubricant with respect to the applying section decreases. As a result, the amount of the lubricant applied to the image carrier via the applying section decreases.

In contrast, according to the aforementioned arrangement, the control section controls the operation so that a period during which the lubricant is kept in contact with the applying member increases as a remaining amount of the lubricant held by the lubricant holding section decreases. As a result, even when a smaller remaining amount of the lubricant causes the pressure or the contact area of the lubricant with respect to the applying section to decrease which results in a smaller amount of the lubricant for each unit time, the amount of the lubricant applied to the image carrier can be kept at a predetermined amount.

Further, the image forming apparatus may be arranged so as to include a storage section for storing a log indicative of a condition under which the image forming apparatus has been used since the lubricant was held by the lubricant holding section (e.g., since the lubricant applying section was produced or since the lubricant was previously replaced), wherein the control section controls the operation of the second contact/separation section in accordance with the log. Note that, for example, the log is any one of (a) an accumulated rotation number or an accumulated travel distance of the image carrier, (b) the number of times images are formed or the number of recording sheets on which images are formed, and (c) an accumulated number of times the applying member is contacted and separated.

According to the arrangement, the operation of the second contact/separation section is controlled in accordance with the log of the image forming apparatus. As a result, it is possible to control the operation of the second contact/separation section according to the remaining amount of the lubricant, so that it is possible to stabilize the amount of the lubricant applied to the image carrier for an extended period of time.

Further, the image forming apparatus may be arranged so that the control section controls the operation of the second contact/separation section so that a period during which the lubricant is kept in contact with the applying member increases as a print density of an image to be formed is higher.

In case where the print density of the image to be formed is high, a larger amount of the lubricant applied to the image carrier is required so as to reduce an amount of toner adhering to the image carrier than in case where the print density is low. Thus, the amount of the lubricant applied to the image carrier is controlled by controlling the second contact/separation apparatus according to the print density of the image to be formed, so that it is possible to stably reduce the amount of toner adhering to the image carrier, and it is possible to more efficiently use the lubricant, thereby reducing the consumption of the lubricant.

Further, the image forming apparatus having the second contact/separation section may be arranged so as to include a charging section for charging the image carrier, wherein the charging section includes: a contact charging member which comes into contact with the image carrier so as to charge the image carrier; a cleaning member which comes into contact with a surface of the contact charging member so as to clean the surface of the contact charging member; and a first contact/separation section for switching a position of the cleaning member between a position where the cleaning member comes into contact with the contact charging member and a position where the cleaning member is separated away from the contact charging member.

Further, still another image forming apparatus includes: an image carrier; a charging section for charging the image carrier; a latent image forming section for forming an electrostatic latent image on the image carrier that has been charged; a developing section for developing the electrostatic latent image, formed on the image carrier, with a developer; a transfer section for transferring an image, obtained by developing the electrostatic latent image on the image carrier, onto a transfer medium; and a lubricant applying section for applying a lubricant to the surface of the image carrier, wherein: the charging section includes (1) a contact charging member which comes into contact with the image carrier so as to charge the image carrier, (2) a cleaning member which comes into contact with a surface of the contact charging member so as to clean the surface of the contact charging member, and (3) a first contact/separation section for switching a position of the cleaning member between a position where the cleaning member comes into contact with the contact charging member and a position where the cleaning member is separated away from the contact charging member, and the lubricant applying section includes (I) a lubricant holding section for holding the lubricant in a solid phase, (II) an applying member for carrying a part of the lubricant held by the lubricant holding section to the surface of the image carrier so as to apply the part of the lubricant to the surface of the image carrier, and (III) a second contact/separation section for switching a position of the lubricant held by the lubricant holding section between a position where the lubricant comes into contact with the applying member and a position where the lubricant is separated away from the applying member.

In each of the foregoing arrangements, the cleaning member can remove unnecessary lubricant adhering to the surface of the contact charging member so as to optimize the amount of the lubricant on the surface of the contact charging member. Further, the cleaning member can uniformise the lubricant on the surface of the contact charging member. Further, when it is not necessary to clean the surface of the contact charging member, the cleaning member is separated away from the contact charging member, thereby suppressing abrasion of the contact charging member.

Further, the image forming apparatus may be arranged so as to a control section for controlling operation of the first contact/separation section and operation of the second contact/separation section, wherein the control section controls the second contact/separation section so as to bring the lubricant into contact with the applying member and then controls the operation of the first contact/separation section so as to bring the cleaning member and the contact charging member into contact with each other by the time the lubricant accordingly applied to the image carrier via the applying member reaches a counter portion opposite to the cleaning member and the contact charging member.

According to the arrangement, when the lubricant is separated away from the applying section, that is, when the lubricant is not applied to the image carrier, the cleaning member is separated away from the contact charging member, and the lubricant is brought into contact with the applying member and then the cleaning member and the contact charging member are brought into contact with each other by the time the lubricant accordingly applied to the image carrier via the applying member reaches a counter portion opposite to the cleaning member and the contact charging member. Thus, it is possible to reduce a period in which the contact charging member and the cleaning member are in contact with each other, so that it is possible to prevent abrasion of the contact charging member. Also, it is possible to prevent excessive adhesion of the lubricant onto the surface of the contact charging member from causing problems such as electric charge leak. Further, it is possible to uniformise the lubricant on the surface of the contact charging member, thereby preventing occurrence of uneven charge.

A lubricant applying apparatus applies a lubricant to a surface of an image carrier for carrying a toner image, said lubricant applying apparatus comprising: a lubricant holding section for holding the lubricant in a solid phase; an applying section for carrying a part of the lubricant held by the lubricant holding section to the surface of the image carrier so as to apply the part of the lubricant to the surface of the image carrier; a second contact/separation section for switching a position of the lubricant held by the lubricant holding section between a position where the lubricant comes into contact with the applying section and a position where the lubricant is separated away from the applying section; and a control section for controlling operation of the second contact/separation section, wherein the control section controls the operation of the second contact/separation section so that a period during which the lubricant is kept in contact with the applying section increases as a remaining amount of the lubricant held by the lubricant holding section decreases.

According to the arrangement, the second contact/separation section can switch a position of the lubricant held by the lubricant holding section between a position where the lubricant comes into contact with the applying section and a position where the lubricant is separated away from the applying section. As a result, it is possible to optimize the amount of the lubricant applied to the image carrier via the applying section, so that it is possible to reduce consumption of the lubricant.

Further, the control section controls the operation of the second contact/separation section, so that it is possible to optimize the amount of the lubricant applied to the image carrier via the applying section. As a result, it is possible to reduce consumption of the lubricant. Also, it is not necessary for the user to operate the second contact/separation section, so that it is possible to improve the usability for the user.

Further, the control section controls the operation of the second contact/separation section so that a period during which the lubricant is kept in contact with the applying section increases as a remaining amount of the lubricant held by the lubricant holding section decreases, thereby stabilizing the amount of the lubricant applied to the image carrier regardless of the remaining amount of the lubricant.

A control method for controlling an image forming apparatus which includes: an image carrier for carrying a toner image; and a lubricant applying section for applying a lubricant to a surface of the image carrier, said lubricant applying section including: a lubricant holding section for holding the lubricant in a solid phase; an applying member for carrying a part of the lubricant held by the lubricant holding section to the surface of the image carrier so as to apply the part of the lubricant to the surface of the image carrier; a second contact/separation section for switching a position of the lubricant held by the lubricant holding section between a position where the lubricant comes into contact with the applying member and a position where the lubricant is separated away from the applying member; and a control section for controlling operation of the second contact/separation section, said control method including the step of setting a period during which the lubricant is kept in contact with the applying section to be longer as a remaining amount of the lubricant held by the lubricant holding section decreases.

According to the method, it is possible to stabilize the amount of the lubricant applied to the image carrier for an extended period of time regardless of the remaining amount of the lubricant.

Another control method for controlling an image forming apparatus which includes: an image carrier for carrying a toner image; and a lubricant applying section for applying a lubricant to a surface of the image carrier, said lubricant applying section including: a lubricant holding section for holding the lubricant in a solid phase; an applying member for carrying a part of the lubricant held by the lubricant holding section to the surface of the image carrier so as to apply the part of the lubricant to the surface of the image carrier; a second contact/separation section for switching a position of the lubricant held by the lubricant holding section between a position where the lubricant comes into contact with the applying member and a position where the lubricant is separated away from the applying member; and a control section for controlling operation of the second contact/separation section, said control method including the step of setting a period during which the lubricant is kept in contact with the applying member to be longer as a print density of an image to be formed is higher.

According to the method, the amount of the lubricant applied to the image carrier is controlled according to the print density of the image to be formed, so that it is possible to stably reduce the amount of toner adhering to the image carrier, and it is possible to more efficiently use the lubricant, thereby reducing consumption of the lubricant.

A still another control method for controlling an image forming apparatus which includes: an image carrier; a charging section for charging the image carrier; a latent image forming section for forming an electrostatic latent image on the image carrier that has been charged; a developing section for developing the electrostatic latent image, formed on the image carrier, with a developer; a transfer section for transferring an image, obtained by developing the electrostatic latent image on the image carrier, onto a transfer medium; and a lubricant applying section for applying a lubricant to the surface of the image carrier, said charging section including (1) a contact charging member which comes into contact with the image carrier so as to charge the image carrier, (2) a cleaning member which comes into contact with a surface of the contact charging member so as to clean the surface of the contact charging member, and (3) a first contact/separation section for switching a position of the cleaning member between a position where the cleaning member comes into contact with the contact charging member and a position where the cleaning member is separated away from the contact charging member, said lubricant applying section including (I) a lubricant holding section for holding the lubricant in a solid phase, (II) an applying member for carrying a part of the lubricant held by the lubricant holding section to the surface of the image carrier so as to apply the part of the lubricant to the surface of the image carrier, and (III) a second contact/separation section for switching a position of the lubricant held by the lubricant holding section between a position where the lubricant comes into contact with the applying member and a position where the lubricant is separated away from the applying member, said control method including the step of controlling the second contact/separation section so as to bring the lubricant into contact with the applying member and then controlling the operation of the first contact/separation section so as to bring the cleaning member and the contact charging member into contact with each other by the time the lubricant accordingly applied to the image carrier via the applying member reaches a counter portion opposite to the cleaning member and the contact charging member.

According to the method, when the lubricant is not applied to the image carrier, the cleaning member is separated away from the contact charging member, and the lubricant is brought into contact with the applying member and then the cleaning member and the contact charging member are brought into contact with each other by the time the lubricant accordingly applied to the image carrier via the applying member reaches a counter portion opposite to the cleaning member and the contact charging member. Thus, the cleaning member can uniformise the lubricant on the surface of the contact charging member, and it is possible to prevent abrasion of the contact charging member.

Note that, the control section may be realized by a computer. In this case, also a program causing the computer to function as the control section and a computer-readable storage medium having the program are included in the present technology.

The embodiments and concrete examples of implementation discussed in the foregoing detailed explanation serve solely to illustrate the technical details, which should not be narrowly interpreted within the limits of such embodiments and concrete examples, but rather may be applied in many variations within the spirit of the present technology, provided such variations do not exceed the scope of the patent claims set forth below.

What is claimed is:

1. An image forming apparatus, comprising:

an image carrier;

a charging section for charging the image carrier, wherein the charging section includes:

a contact charging member which conies into contact with the image carrier so as to charge the image carrier, a cleaning member which comes into contact with a surface of the contact charging member so as to clean the surface of the contact charging member, and a first contact/separation section for switching a position of the cleaning member between a position where the cleaning member comes into contact with the contact charging member and a position where the cleaning member is separated away from the contact charging member;

a latent image forming section for forming an electrostatic latent image on the image carrier that has been charged;

a developing section for developing the electrostatic latent image, formed on the image carrier, with a developer;

a transfer section for transferring an image, obtained by developing the electrostatic latent image on the image carrier, onto a transfer medium;

a cleaning section for cleaning a surface of the image carrier after transferring the image; and a lubricant applying section for applying a lubricant to the surface of the image carrier, wherein the lubricant applying section applies the lubricant to the surface of the image carrier which has been cleaned and has not been charged, and wherein the lubricant applying section comprises:

a lubricant holding section for holding a solid phase lubricant, an applying member for transferring lubricant from the lubricant holding section to the surface of the image carrier, and a second contact/separation section for switching a position of the lubricant held by the lubricant holding section between a position where the lubricant comes into contact with the applying member and a position where the lubricant is separated from the applying member, wherein the first contact/separation section causes the cleaning member to come into contact with the contact charging member during periods when the second contact/separation section is causing the lubricant to come into contact with the applying member so that lubricant is being applied to the image carrier.

2. The image forming apparatus as set forth in claim 1, further comprising a control section for controlling operation of the second contact/separation section period during which the lubricant is kept in contact with the applying member increases as a remaining amount of the lubricant held by the lubricant holding section decreases.

3. The image forming apparatus as set forth in claim 2, comprising a storage section for storing a log indicative of a condition under which the image forming apparatus has been used since the lubricant was held by the lubricant holding section, wherein the control section controls the operation of the second contact/separation section in accordance with the log.

4. The image forming apparatus as set forth in claim 3, wherein the log is any one of (a) an accumulated rotation number or an accumulated travel distance of the image carrier, (b) the number of times images are formed or the number of recording sheets on which images are formed, and (c) an accumulated number of times the applying member is contacted and separated.

5. The image forming apparatus as set forth in claim 1, further comprising a control section for controlling operation of the second contact/separation section so that a period during which the lubricant is kept in contact with the applying member increases as a print density of an image to be formed is higher.

6. An image forming apparatus, comprising:

an image carrier;

a charging section for charging the image carrier, wherein the charging section includes:

a contact charging member which comes into contact with the image carrier so as to charge the image carrier, a cleaning member which comes into contact with a surface of the charging member so as to clean the surface of the charging member, and a first contact/separation section for switching a position of the cleaning member between a position where the cleaning member comes into contact with the contact charging member and a position where the cleaning member is separated away from the contact charging member:

a latent image forming section for forming an electrostatic latent image on the image carrier that has been charged;

a developing section for developing the electrostatic latent image, formed on the image carrier, with a developer;

a transfer section for transferring an image, obtained by developing the electrostatic latent image on the image carrier, onto a transfer medium;

a lubricant applying section for applying a lubricant to the surface of the image carrier, wherein the lubricant applying section includes:

a lubricant holding section for holding a solid phase lubricant.

an applying member for transferring lubricant from the lubricant holding section to the surface of the image carrier, and a second contact/separation section for switching a position of the lubricant held by the lubricant holding section between a position where the lubricant comes into contact with the applying member and a position where the lubricant is separated from the applying member; and a control section for controlling operations of the first contact/separation section and the second contact/separation section, wherein the control section controls the second contact/separation section so as to bring the lubricant into contact with the applying member and then controls the operation of the first contact/separation section so as to bring the cleaning member and the contact charging member into contact with each other by the time the lubricant accordingly applied to the image carrier via the applying member reaches a position opposite to the cleaning member and the contact charging member.

7. A control method of an image forming apparatus which includes: an image carrier; a charging section for charging the image carrier; a latent image forming section for forming an electrostatic latent image on the image carrier that has been charged; a developing section for developing the electrostatic latent image, formed on the image carrier, with a developer; a transfer section for transferring an image, obtained by developing the electrostatic latent image on the image carrier, onto a transfer medium; and a lubricant applying section for applying a lubricant to the surface of the image carrier, said charging section including (1) a contact charging member which comes into contact with the image carrier so as to charge the image carrier, (2) a cleaning member which comes into contact with a surface of the contact charging member so as to clean the surface of the contact charging member, and (3) a first contact/separation section for switching a position of the cleaning member between a position where the cleaning member comes into contact with the contact charging member and a position where the cleaning member is separated away from the contact charging member, said lubricant applying section including (I) a lubricant holding section for holding the lubricant in a solid phase, (II) an applying member for carrying a part of the lubricant held by the lubricant holding section to the surface of the image carrier so as to apply the part of the lubricant to the surface of the image carrier, and (III) a second contact/separation section for switching a position of the lubricant held by the lubricant holding section between a position where the lubricant comes into contact with the applying member and a position where the lubricant is separated away from the applying member, said control method comprising the step of controlling the second contact/separation section so as to bring the lubricant into contact with the applying member and then controlling the operation of the first contact/separation section so as to bring the cleaning member and the contact charging member into contact with each other by the time the lubricant accordingly applied to the image carrier via the applying member reaches a counter portion opposite to the cleaning member and the contact charging member.

8. A computer-readable storage medium, storing a program causing a computer to function as a control section of an image forming apparatus, said image forming apparatus comprising: an image carrier; a charging section for charging the image carrier; a latent image forming section for forming an electrostatic latent image on the image carrier that has been charged; a developing section for developing the electrostatic latent image, formed on the image carrier, with a developer; a transfer section for transferring an image, obtained by developing the electrostatic latent image on the image carrier, onto a transfer medium; and a lubricant applying section for applying a lubricant to the surface of the image carrier, wherein:

the charging section includes (1) a contact charging member which comes into contact with the image carrier so as to charge the image carrier, (2) a cleaning member which comes into contact with a surface of the contact charging member so as to clean the surface of the contact charging member, and (3) a first contact/separation section for switching a position of the cleaning member between a position where the cleaning member comes into contact with the contact charging member and a position where the cleaning member is separated away from the contact charging member, and the lubricant applying section includes (I) a lubricant holding section for holding the lubricant in a solid phase, (II) an applying member for carrying a part of the lubricant held by the lubricant holding section to the surface of the image carrier so as to apply the part of the lubricant to the surface of the image carrier, and (III) a second contact/separation section for switching a position of the lubricant held by the lubricant holding section between a position where the lubricant comes into contact with the applying member and a position where the lubricant is separated away from the applying member, wherein:

the computer program causes the control section to control the second contact/separation section so as to bring the lubricant into contact with the applying member and then controls the operation of the first contact/separation section so as to bring the cleaning member and the contact charging member into contact with each other by the time the lubricant accordingly applied to the image carrier via the applying member reaches a counter portion opposite to the cleaning member and the contact charging member.

9. The image forming apparatus as set forth in claim 2, wherein the control section controls the first contact/separation section and the second contact/separation section such that after the second contact/separation section causes the lubricant to be separated from the applying member, the first contact/separation section causes the cleaning member to move to a position where it is separated away from the contact charging member right after the last of the lubricant applied by the applying member before the lubricant was separated from the applying member reaches a position opposite to the contact charging member and the cleaning member.

10. The image forming apparatus as set forth in claim 6, wherein the control section controls the first contact/separation section and the second contact/separation section such that after the second contact/separation section causes the lubricant to be separated from the applying member, the first contact/separation section causes the cleaning member to move to a position where it is separated away from the contact charging member right after the last of the lubricant applied by the applying member before the lubricant was separated from the applying member reaches a position opposite to the contact charging member and the cleaning member.

11. The control method of claim 7, further comprising the steps of:

controlling the second contact/separation section to cause the lubricant to be separated from the applying member; and controlling the first contact/separation section to cause the cleaning member to move to a position where it is separated away from the contact charging member right after the last of the lubricant applied by the applying member before the lubricant was separated from the applying member reaches a position opposite to the contact charging member and the cleaning member.

12. The computer-readable storage medium of claim 8, wherein the computer program also causes the control section to:

control the second contact/separation section to cause the lubricant to be separated from the applying member; and control the first contact/separation section to cause the cleaning member to move to a position where it is separated away from the contact charging member right after the last of the lubricant applied by the applying member before the lubricant was separated from the applying member reaches a position opposite to the contact charging member and the cleaning member.

* * * * *